US008138928B2

(12) United States Patent
Farley et al.

(10) Patent No.: US 8,138,928 B2
(45) Date of Patent: Mar. 20, 2012

(54) MULTIPLE EVENT NOTIFICATION APPLIANCE

(75) Inventors: Daniel G. Farley, Westminster, MA (US); Todd Shearer, Ocean, NJ (US); John Durst, Kingston, NY (US)

(73) Assignee: SimplexGrinnell LP, Westminster, MA (US)

( * ) Notice: Subject to any disclaimer, the term of this patent is extended or adjusted under 35 U.S.C. 154(b) by 510 days.

(21) Appl. No.: 12/360,461

(22) Filed: Jan. 27, 2009

(65) Prior Publication Data

US 2010/0188234 A1 Jul. 29, 2010

(51) Int. Cl.
*G08B 17/12* (2006.01)

(52) U.S. Cl. ..... 340/577; 340/539.26; 340/539.27

(58) Field of Classification Search ..... 340/577
See application file for complete search history.

(56) References Cited

U.S. PATENT DOCUMENTS

| | | | | |
|---|---|---|---|---|
| 5,552,763 | A | 9/1996 | Kirby | |
| 5,622,427 | A | 4/1997 | Lemons et al. | |
| 5,865,527 | A | 2/1999 | Lemons et al. | |
| 6,127,935 | A * | 10/2000 | Davidson et al. | 340/691.5 |
| 7,665,874 | B2 * | 2/2010 | Chadwell et al. | 362/561 |
| 7,920,053 | B2 * | 4/2011 | Pattok et al. | 340/331 |
| 2007/0103329 | A1 * | 5/2007 | Lin | 340/691.1 |
| 2007/0230170 | A1 * | 10/2007 | Mita et al. | 362/231 |
| 2009/0066522 | A1 * | 3/2009 | Lee et al. | 340/577 |
| 2010/0090856 | A1 * | 4/2010 | Chen | 340/691.6 |

* cited by examiner

*Primary Examiner* — George Bugg
*Assistant Examiner* — Kerri McNally
(74) *Attorney, Agent, or Firm* — Grossman Tucker Perreault & Pfleger

(57) ABSTRACT

An apparatus, system and method including an event notification appliance including first and second light sources configured to indicate an event, including a fire and/or alert.

17 Claims, 5 Drawing Sheets

MULTIPLE EVENT NOTIFICATION APPLIANCE

TECHNICAL FIELD

The present application relates to a multiple event notification system that may include both fire and alert notification capability.

BACKGROUND

Event notification systems including event notification appliances are often used in buildings to signal emergency conditions, e.g., fire. In order to provide coverage throughout a building, the building's event notification system may include several event notification appliances. Event notification appliances may provide visible and/or audible indicators of an emergency condition, e.g. in a manner consistent with related standards such as the National Fire Alarm Code® (NFPA 72), ANSI A117.1 (Standard on Accessible and Usable Buildings and Facilities), local building codes and/or guidelines of the Americans with Disabilities Act (ADA). For example, fire alarms typically include a strobe-type visible light producing portion and may include an audible warning device, e.g., a siren.

Event notification appliances may also be used to signal events other than fire, i.e., alerts. Event notification appliances that indicate occurrence of a fire are typically dedicated to signaling fire. If signaling events other than fire events is desired, additional event notification appliances may be needed to provide this notification function. Additional event notification appliances may add cost and complexity to the building's event notification system. Accordingly, it may be desirable to combine more than one event type, e.g., fire and/or alert, in an event notification appliance.

BRIEF DESCRIPTION OF THE DRAWINGS

Reference should be made to the following detailed description which should be read in conjunction with the following figures, wherein like numerals represent like parts.

DETAILED DESCRIPTION

In general, a system, apparatus and method consistent with the present disclosure may include an event notification appliance configured to indicate a plurality of events including fire. The event notification appliance may be configured to emit light and/or sound when activated. A fire may be indicated by emitting a fire notification light at a first wavelength. An alert, i.e., an event other than a fire, may be indicated by emitting an alert notification light at a second wavelength. The first and second wavelengths may be selected so that light at the first wavelength may be readily visually discernable from the light at the second wavelength, whereby occupants of a building or location including a notification appliance consistent with the present disclosure may perceive light at the first and second wavelengths as signifying different events. Additionally or alternatively, events may be indicated on an event notification appliance by illuminating lettering, e.g., "ALERT" to indicate an event other than a fire and/or "FIRE" to indicate fire.

Figure 1:
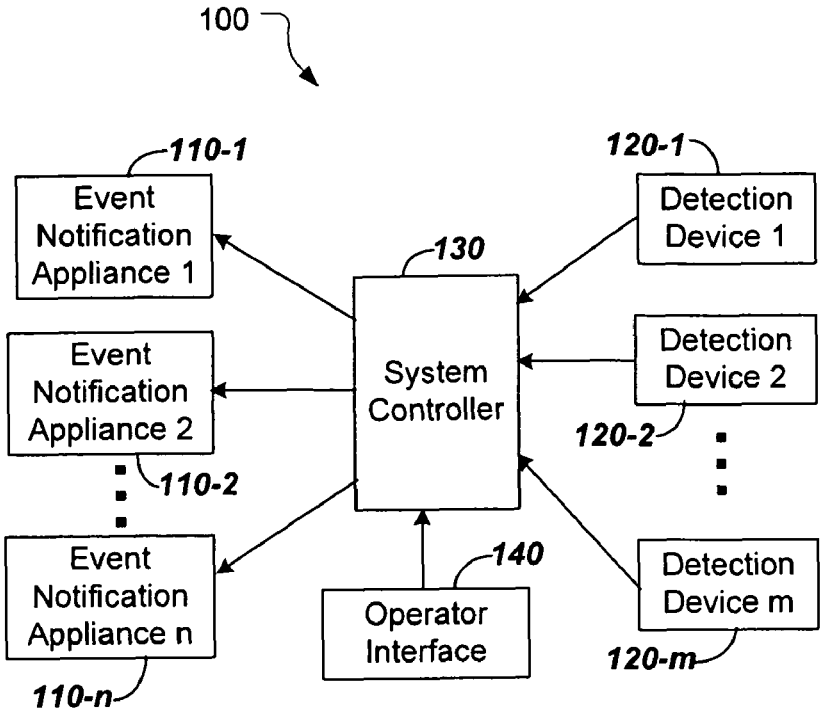
FIG. 1 is a block diagram of one exemplary embodiment of a system consistent with the present disclosure.

FIG. 1 is a block diagram of one exemplary system 100 consistent with the present disclosure. A system consistent with the present disclosure may include one or more event notification appliances 110-1, 110-2 . . . **110-*n*. The event notification appliances 110-1, 110-2 . . . 110-*n* may be distributed throughout the interior and/or exterior of a building or location for providing notifications to occupants thereof. The term "occupants" as used herein shall refer to human beings located at the interior or exterior of a building or location where one or more notification appliances consistent with the present disclosure are installed. The system may further include one or more detection devices 120-1, 120-2 . . . 120-*m*. The event notification appliances 110-1, 110-2 . . . 110-*n* and detection devices 120-1, 120-2 . . . 120-*m* are illustrated in FIG. 1** as separate components for ease of explanation and illustration. It is to be understood that one or more of the detection devices may be incorporated into an event notification appliance to provide an integral unit.

Each detection device 120-1, 120-2 . . . **120-*m* may be configured to detect one or more events. An event may include a fire and/or an alert. An alert may include, e.g., detection of an intruder, discharge of a firearm, a security breach, a dangerous weather event such as a tornado warning and/or any event where notification of building occupants may be desired. Each event notification appliance 110-1, 110-2 . . . 110-*n* and each detection device 120-1, 120-2 . . . 120-*m* may be coupled to a system controller 130**.

Additionally or alternatively, an operator interface 140 may be coupled to the system controller 130. In an embodiment, the operator interface 140 may include a keyboard, a push button, a lever, a handle, and/or similar device known to those skilled in the art. Additionally or alternatively, the operator interface 140 may include a display and/or an indicator. The operator interface 140 may be configured to be accessed and/or actuated by an operator, e.g., an occupant, to initiate notification of an event. For example, an occupant may detect an event (e.g., presence of an intruder) and may wish to initiate notification of the event. The occupant may initiate notification of the event by accessing and/or actuating the operator interface 140. In an embodiment, the display and/or indicator may provide confirmation to the occupant that notification of the event has been initiated.

An event notification appliance 110-1, 110-2 . . . **110-*n* may be configured to be activated in response to a signal indicating an event. The signal indicating an event may be provided by a detection device 120-1, 120-2 . . . 120-*m*, the operator interface 140 and/or the system controller 130. For example, the system controller 130 may be configured to receive data from each detection device 120-1, 120-2 . . . 120-*m* and/or the operator interface 140 and to activate an event notification appliance 110-1, 110-2 . . . 110-*n* based at least in part on the data from each detection device 120-1, 120-2 . . . 120-*m* and/or the operator interface 140. For example, the system 100** may include features such as those disclosed in U.S. Pat. Nos. 5,886,620 and 6,313,744, the teachings of which are hereby incorporated by reference in their entirety.

An event notification appliance, e.g., event notification appliance 110-1, 110-2 . . . **110-*n***, may generally include a visible light-producing portion and a sound producing portion. The visible light producing portion may include a light source, a reflector and a protective dome. The protective dome may be transparent or translucent. The protective dome may be a lens. The light source may be positioned relative to the reflector to distribute light, when energized, at an intensity over a defined region about the event notification device. The light source may be configured to provide substantially continuous illumination and/or intermittent illumination, e.g., pulsed illumination as from a strobe. Intermittent illumination may include emitting flashes, i.e., relatively short duration, relatively high intensity pulses of light. For example, the light source may be a Xenon lamp or high intensity LED. The sound producing portion may be configured to emit a sound indicating an event. The sound producing portion may be an audible warning device. The audible warning device may include a siren, an audible horn, a loudspeaker, a buzzer and/or the like.

Figure 2A:
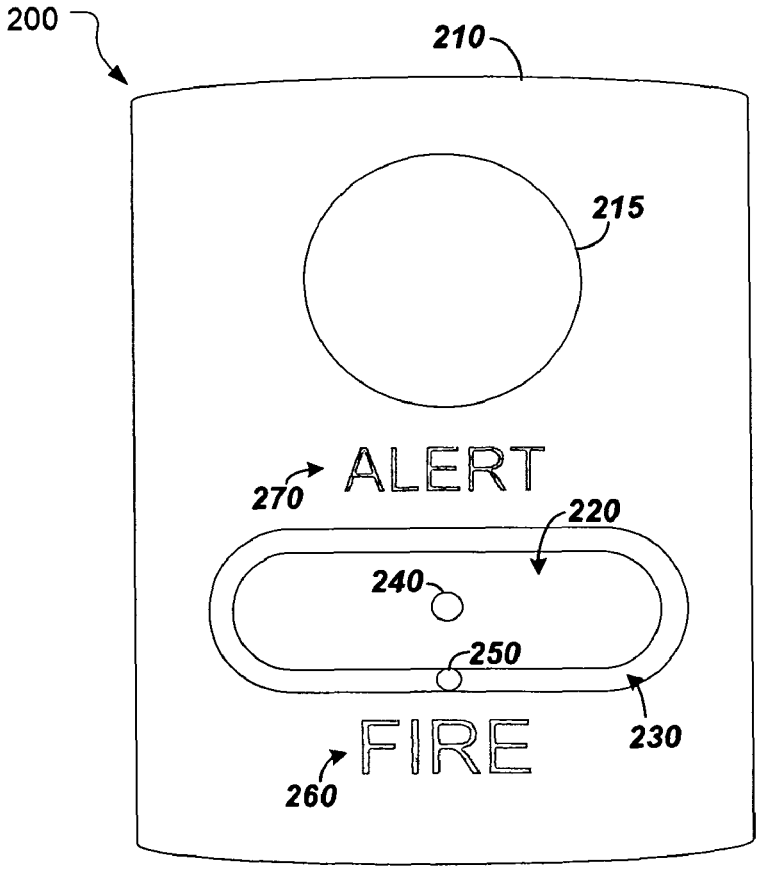
FIGS. 2A and 2B are a front view and a side view, respectively, of an exemplary embodiment of an event notification appliance consistent with the present disclosure.
Figure 2B:
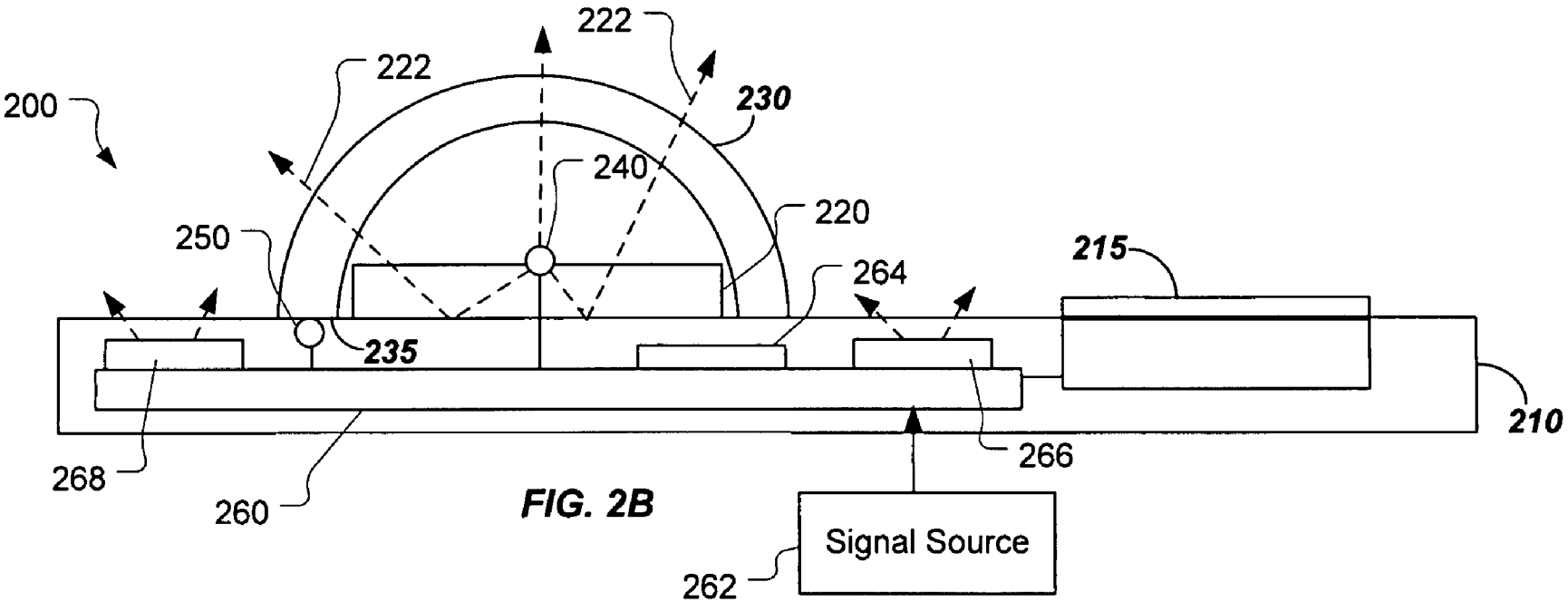

FIGS. 2A and 2B are a front view and a side view, respectively, of an exemplary embodiment of an event notification appliance 200 consistent with the present disclosure. As shown, the event notification appliance 200 may include a housing 210, a printed circuit board 260 (PCB), an audible warning device, e.g., sound generator 215, a reflector 220, a protective dome 230, a first light source 240 and a second light source 250. As shown, the first light source 240 may be coupled to or positioned adjacent the reflector 220 in a known manner. The first light source 240, when energized, may emit a fire notification light at a first wavelength to indicate a fire condition. At least a portion of the fire notification light may be reflected by the reflector 220, as generally illustrated by arrows 222 and directed through the protective dome 230.

The reflector 220 is depicted as having a rectangular shape for ease of illustration. The reflector 220 may take a known configuration including features configured to reflect incident light from the first light source 240. The features may be configured to reflect the incident light in an intensity pattern relative to the event notification appliance 200. For example, the reflector 220 may include features such as those disclosed in U.S. Pat. Nos. 5,622,427 and/or 5,865,527, the teachings of which are hereby incorporated by reference in their entirety.

As shown, the second light source 250 may be disposed in, on or adjacent an end surface 235 of the protective dome 230. In one embodiment, the second light source 250 may be a relatively high intensity LED. The second light source 250 may be configured to emit an alert notification light at a second wavelength to indicate a non-fire alert condition. The second wavelength may be different from the first wavelength so as to be perceived as indicating an alert condition. In one embodiment, the second light source 250 may be configured to emit the alert notification light into the protective dome 230. When the second light source 250 is activated, at least a portion of the protective dome 230 may be perceived as indicating an alert.

The first and second light sources and the sound generator may be electrically coupled to the PCB 260. A signal source 262, such as a system controller 130 and/or detection device 120 may also be coupled to the PCB. The signal source may be configured to provide an associated output to the PCB 260 in response to a fire and/or non-fire event. In response to the output(s) from the signal source 262, decision logic 264 on the PCB may cause the first light source 240, the second light source 250, and/or the sound generator 215 to be energized to provide notification of a fire and/or non-fire event. The respective wavelengths of the fire notification light from the first light source 240 and the alert notification light from the second light source 250 may be may be selected so that the fire notification light and the alert notification light are readily visually discernable from each other, whereby occupants of a building or location including a notification appliance consistent with the present disclosure may perceive light the notification appliance as providing a fire notification or alert notification.

The appliance 200 may also be configured to illuminate lettering associated with a fire or non-fire alert. As shown, for example, the housing 210 may generally be opaque and may define lettering, e.g., "FIRE" 260 and/or "ALERT" 270. In one embodiment, the lettering 260, 270 may be at least semi-transparent. As used herein, semitransparent may be understood to mean allowing at least a portion of incident light to pass through.

When no event is being indicated, i.e., the first and second light sources are not activated, the lettering 260, 270 may not be visible except upon relatively close inspection. When an event is being indicated, the "FIRE" 260 and/or "ALERT" 270 lettering may be illuminated relative to the housing 210. The illumination may be continuous and/or intermittent. For example, the lettering 260, 270 may be back illuminated, i.e., illuminated from behind the housing 210 by associated illumination sources 266, 268 coupled to the PCB. The illumination sources may emit light at the same or different wavelengths through the lettering. As a result, the "FIRE" 260 and/or "ALERT" 270 lettering may be visible at a distance from the event notification appliance 200, thereby providing an additional visual indicator to aid in differentiating a fire condition from an alert condition.

The protective dome 230 may be translucent. Additionally or alternatively, the protective dome 230 may be substantially transparent. As used herein, translucent may be understood to mean configured to transmit and diffuse light. As used herein, transparent may be understood to mean configured to transmit light without substantially diffusing the light. Accordingly, the protective dome 230 may allow incident light to pass through.

Figure 3:
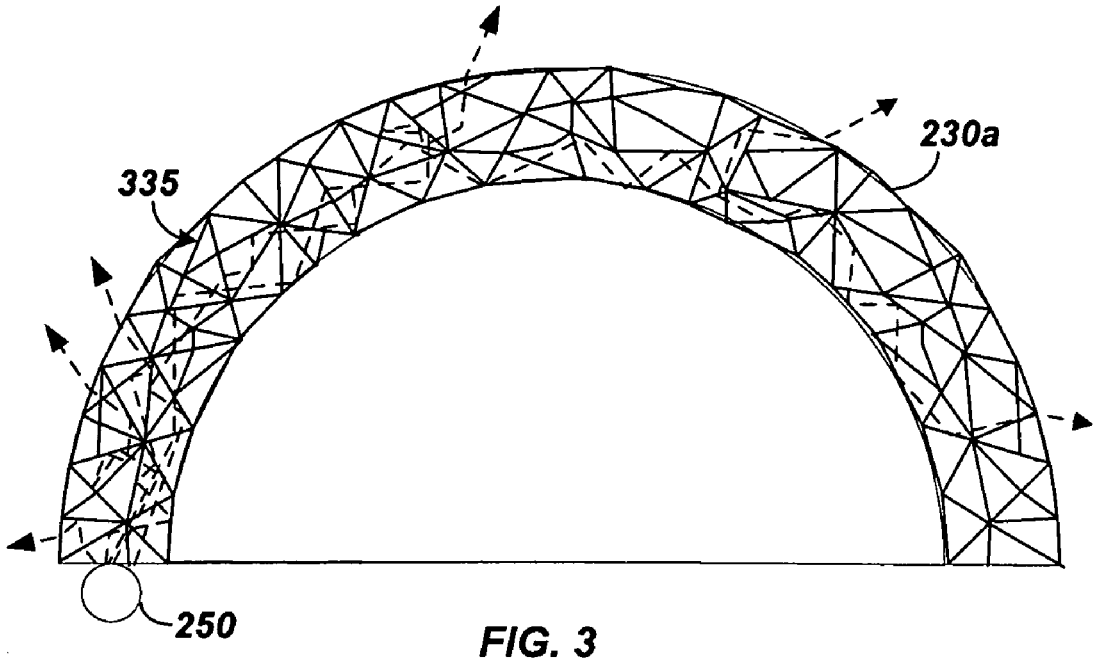
FIGS. 3 and 4 are cross-sectional views of exemplary embodiments of a protective dome useful in an event notification appliance consistent with the present disclosure.
Figure 4:
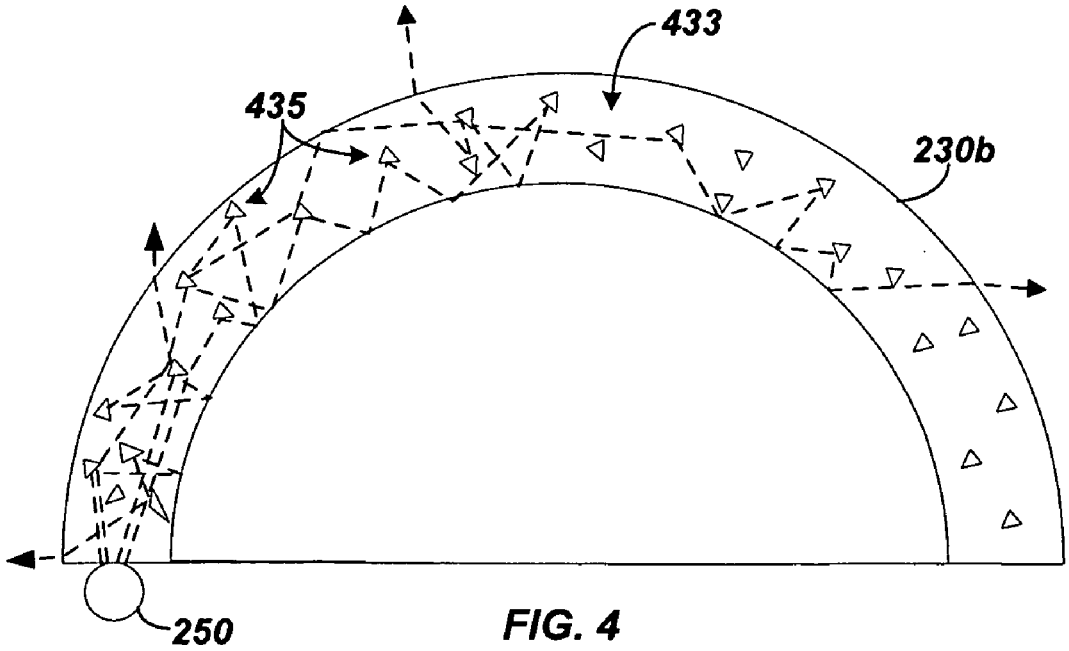

FIGS. 3 and 4 are side views of exemplary embodiments of a protective dome **230*a*, 230*b* and second light source 250, consistent with the present disclosure. In FIGS. 3 and 4, examples of paths and directions of alert notification light are depicted by dotted lines and arrows, respectively. The protective domes 230*a*, 230*b* may include a structure and/or material that may be configured to reflect and/or refract the alert notification light within the protective dome 230*a*, 230*b*. Additionally or alternatively, the structure and/or material may be configured to preferentially transmit and/or reflect the alert notification light outward, away from the event notification appliance 200**.

For example, as shown in FIG. 3, the protective dome **230*a* may include a non-uniform region, e.g., a prism-type structure 335 that may provide a plurality of reflecting and/or refracting surfaces configured to direct the alert notification light within and/or outward from the protective dome 230*a*. In FIG. 3, examples of paths and directions of alert notification light that may be reflected and/or refracted by the prism-type structure 335 are indicated by the dotted lines and arrows. It may be appreciated that an increase in a number of reflections and/or refractions may yield a relatively more uniform distribution of alert notification light in the protective dome 230*a***.

In another example, as shown in FIG. 4, the protective dome **230*b* may include a first material 433 and a second material 435. The combination of materials may provide non-uniformities in the protective dome 230*b* that may preferentially reflect and/or refract the alert notification light in the protective dome 230***b*. FIG. 4 includes examples of paths (dotted lines) and directions (arrows) of alert notification light that may be reflected and/or refracted by the combination of materials.

For example, the protective dome 230*b* may be constructed mainly of the first material 433. A plurality of relatively small volumes or particles of the second material 433 may be distributed throughout the first material 433 of the protective dome 230*b*. The first material 433 may provide a shape and structure of the protective dome 230*b*. The second material 435 may provide a plurality of reflecting and/or refracting surfaces. The first material 433 may be a substantially transparent polymeric material, e.g., plastic. For example, the first material may be polycarbonate, polyvinyl chloride or polymethyl methacrylate. The second material 435 may be a reflective metallic material and/or the second material may be air. It may be appreciated that an increase in a number of reflections and/or refractions may yield a relatively more uniform distribution of alert notification light in the protective dome 230*b*.

Figure 5A:
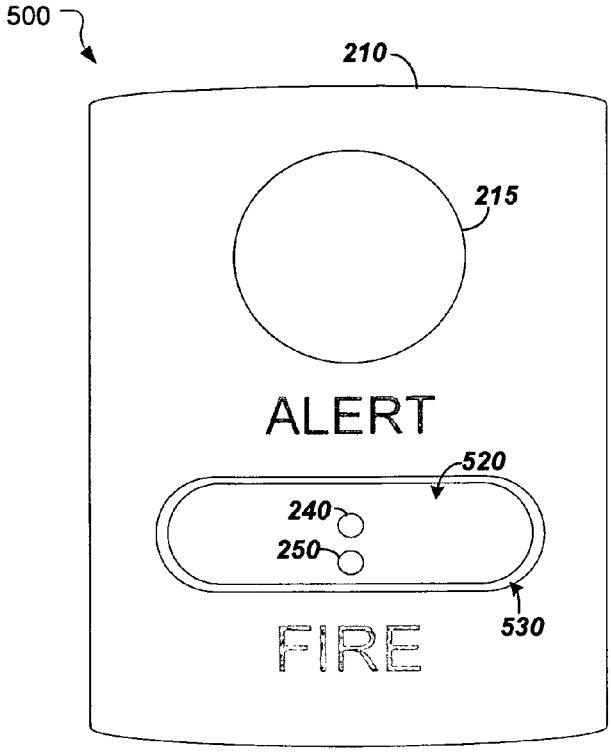
FIGS. 5A and 5B are a front view and a side view, respectively, of another exemplary embodiment of an event notification appliance consistent with the present disclosure.
Figure 5B:
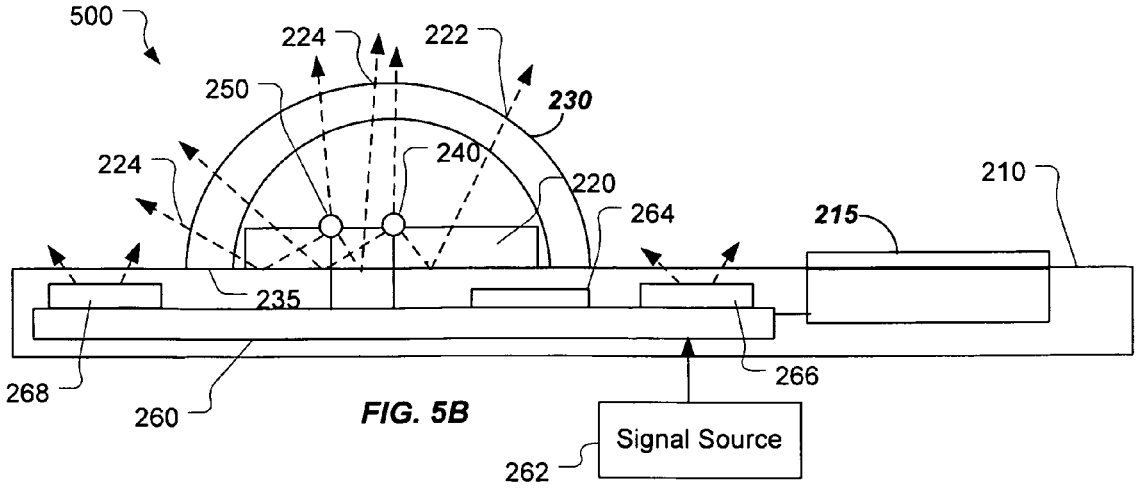

FIGS. 5A and 5B are a front view and a side view of another exemplary embodiment of an event notification appliance 500, consistent with the present disclosure. As shown, the event notification appliance 500 may include a housing 210, a printed circuit board 260 (PCB), an audible warning device, e.g., sound generator 215, a reflector 220, a protective dome 230, a first light source 240 and a second light source 250. In the illustrated embodiment, both the first light source 240 and the second light source 250 may be coupled to or positioned adjacent the reflector 220. The first light source 240, when energized, may emit a fire notification light at a first wavelength to indicate a fire condition. At least a portion of the fire notification light may be reflected by the reflector 220, as generally illustrated by arrows 222 and directed through the protective dome 230. The second light source 250, when energized, may emit an alert notification light at a second wavelength to indicate a non-fire alert condition. At least a portion of the alert notification light may be reflected by the reflector 220, as generally illustrated by arrows 224 and directed through the protective dome 230.

As discussed above, the signal source may be configured to provide an associated output to the PCB 260 in response to a fire and/or non-fire event. In response to the output(s) from the signal source 262, decision logic 264 on the PCB may cause the first light source 240, the second light source 250, and/or the sound generator 215 to be energized to provide notification of a fire and/or non-fire event. The respective wavelengths of the fire notification light from the first light source 240 and the alert notification light from the second light source 250 may be may be selected so that the fire notification light and the alert notification light are readily visually discernable from each other, whereby occupants of a building or location including a notification appliance consistent with the present disclosure may perceive light the notification appliance as providing a fire notification or alert notification.

Figure 6:
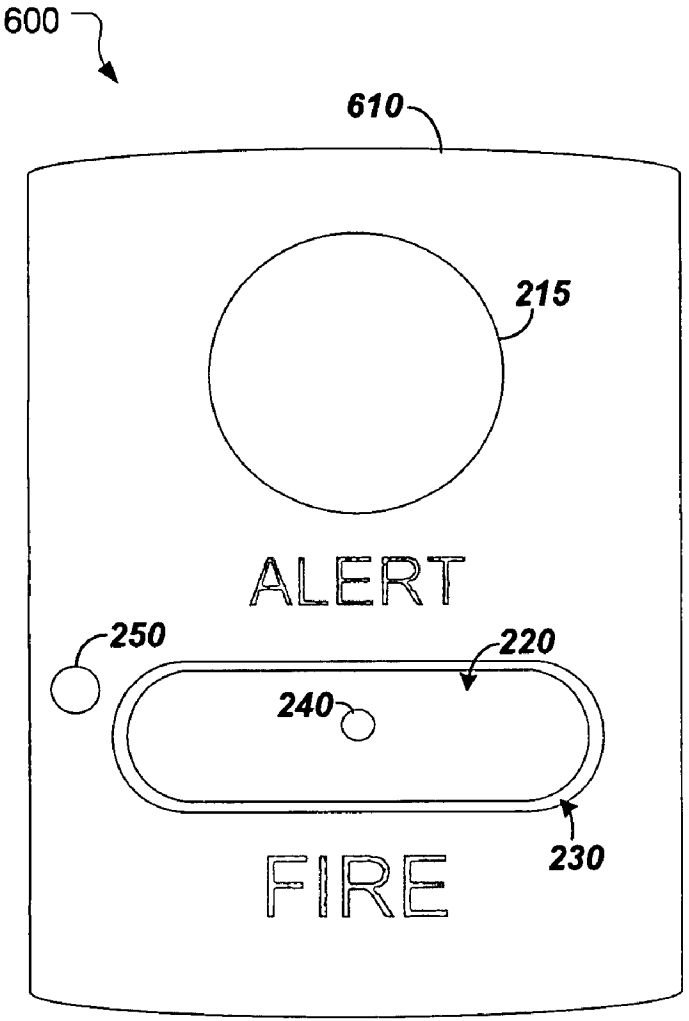
FIG. 6 is a front view of yet another exemplary embodiment of an event notification appliance consistent with the present disclosure.

FIG. 6 is yet another exemplary embodiment of an event notification appliance 600, consistent with the present disclosure. Similar to the embodiments discussed above, the event notification appliance 600 may include a housing 610, an audible warning device, e.g., sound generator 215, the reflector 220, the protective dome 230 and first 240 and second 250 sources. In the illustrated exemplary embodiment, the first light source is positioned on or adjacent to the reflector, e.g. as shown in FIGS. 2B and 5B, but the second light source 250 is disposed in or on the housing 610 adjacent, but outside of, the protective dome 230. As described above, the light sources 240, 250 and sound generator 215 may be energized in response to a signal from a signal source to provide notification of a fire and/or a non-fire alert.

In the foregoing, each event notification appliance has been described as configured to indicate a fire condition and/or an alert condition. It may be appreciated that an event notification appliance may be configured to indicate more than one alert condition. In an embodiment, the event notification appliance may be configured to notify a plurality of alert conditions with the addition of one or more light sources configured substantially similar to a second light source 250. Each light source may be configured to indicate an associated alert condition. For example, each of the plurality of light sources may be configured to emit a different associated alert notification light at an associated wavelength to indicate an alert condition. Additionally or alternatively, a single second light source 250 may be configured to emit a plurality of alert notification lights, each light at a different wavelength to indicate each alert condition. Also, a plurality of second light sources 250 may be combined in an event notification appliance to indicate a fire condition and/or more than one alert condition.

Figure 7:
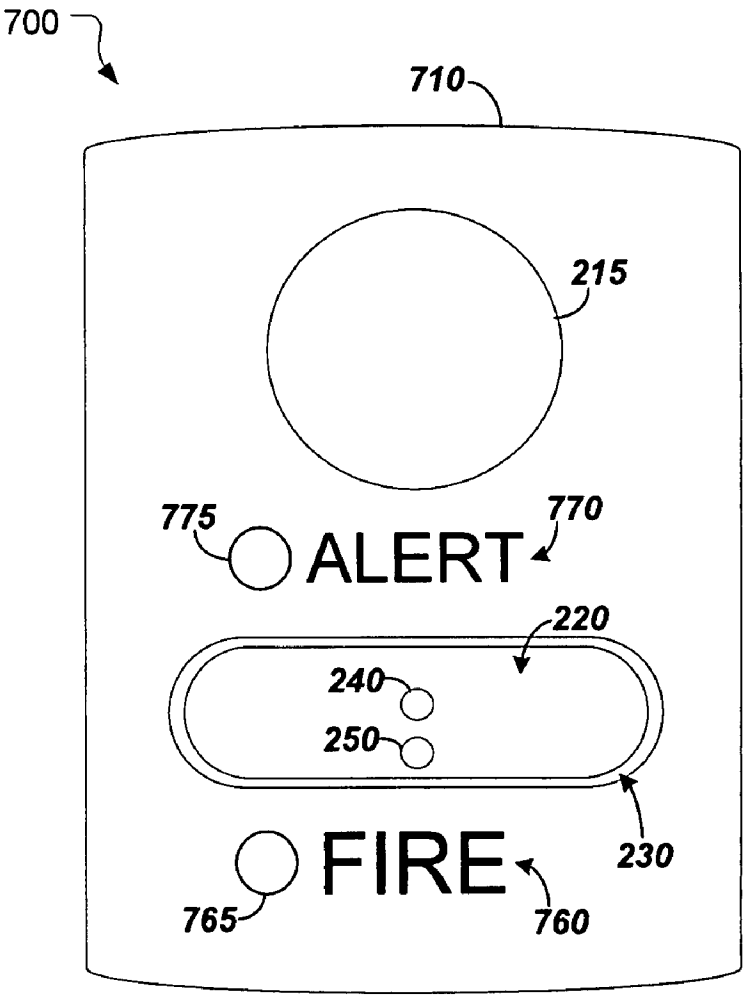
FIG. 7 is a front view of another exemplary embodiment of an event notification appliance consistent with the present disclosure.

FIG. 7 illustrates another embodiment 700 of an event notification appliance consistent with the present disclosure. As shown, the housing 710 may include lettering, e.g., "FIRE" 760 and/or "ALERT" 770. A color of the lettering 760, 770 may be perceived to be different from the color of the housing 710 so that the lettering 760, 770 may generally be visible independent of whether the event notification appliance 700 is activated or not. The event notification appliance 700 may further include a first event indicator 765 and a second 775 event indicator. The first event indicator 765 may be positioned adjacent to and associated with the "FIRE" lettering 760 and the second event indicator 775 may be positioned adjacent to and associated with the "ALERT" lettering 770. The first 765 and/or second 775 event indicators may include light sources.

The first 765 event indicator may be configured to direct attention to the "FIRE" lettering 760 and/or the second 775 event indicator may be configured to direct attention to the "ALERT" lettering 770. When the event notification appliance 700 is not activated, the first and second event indicators 765, 775 may not be activated. When the event notification appliance 700 is activated to indicate a fire condition, for example, the first event indicator 765 may be activated. Similarly, when the event notification appliance 700 is activated to indicate an alert condition, the second event indicator 775 may be activated. In one embodiment, the first and second event indicators 765, 775 may be light sources, such as light emitting diodes (LEDs), coupled to the PCB, e.g. similarly to sources 266 and 268 in FIG. 2B, that may be illuminated continuously and/or intermittently to indicate an event condition.

As shown in FIGS. 2A, 5A, 6, and 7, for example, an event notification appliance may include a combination of lettering, event indicators and/or a second light source, to indicate a fire condition and/or an alert condition. The lettering, event indicators, first light source and/or second light source may be configured to indicate an event condition, and to further indicate whether an event condition is an alert condition, a fire condition or both an alert condition and a fire condition.

According to one aspect of the disclosure, there is thus provided an event notification appliance including a first light source configured to emit light at a first wavelength, a reflector adjacent the first light source, the reflector configured to reflect the light at the first wavelength and a second light source configured to emit light at a second wavelength, the second wavelength being different from the first wavelength.

According to another aspect of the disclosure, there is provided a system including an event notification appliance including: a first light source configured to emit light at a first wavelength; a reflector adjacent the first light source, the reflector configured to reflect the light at the first wavelength; and a second light source configured to emit light at a second wavelength, the second wavelength being different from the first wavelength; and a signal source coupled to the event notification appliance, the signal source providing an output to the event notification appliance in response to detection of a fire or a non-fire alert condition. The event notification appliance is configured to energize the first light source or the second light source in response to the output from the signal source to provide a visual notification of the fire or the non-fire alert condition.

According to yet another aspect of the disclosure there is provided a method of indicating an event including: detecting the event, energizing a first light source of an event notification appliance if the event is a fire event, the first light source emitting light at a first wavelength; and energizing a second light source of the event notification appliance if the event is a non-fire alert condition, the second light source emitting light at a second wavelength, the second wavelength being different from the first wavelength.

The embodiments that have been described herein but some of the several which utilize a system or method consistent with the present disclosure and are set forth herein by way of illustration but not of limitation. Many other embodiments, which will be readily apparent to those skilled in the art, may be made without departing materially from the spirit and scope of the disclosure.

What is claimed is:

1. An event notification appliance comprising:

a first light source configured to emit light at a first wavelength;

a reflector adjacent said first light source, said reflector configured to reflect said light at said first wavelength through a protective dome; and a second light source positioned to emit light at a second wavelength into an end surface of said protective dome, said second wavelength being different from said first wavelength, said protective dome being configured to direct said light at said second wavelength outwardly from said dome;

wherein said protective dome comprises a plurality of surfaces configured to direct said light at said second wavelength outwardly from said dome.

2. The event notification appliance of claim 1 wherein said second light source is positioned adjacent said reflector, wherein said reflector is configured to reflect at least a portion of said light at said second wavelength.

3. The event notification appliance of claim 1 further comprising a housing comprising a first lettering and a second lettering.

4. The event notification appliance of claim 3 wherein said second light source is coupled to said housing.

5. The event notification appliance of claim 3 wherein said first lettering and said second lettering are defined by said housing, and wherein said appliance further comprises a first illumination source configured for backlighting said first lettering to indicate a fire condition and a second illumination source configured for backlighting said second lettering to indicate an alert condition.

6. The event notification appliance of claim 3 further comprising a first event indicator adjacent said first lettering and a second event indicator adjacent said second lettering.

7. A system comprising:

an event notification appliance comprising:

a first light source configured to emit light at a first wavelength;

a reflector adjacent said first light source, said reflector configured to reflect said light at said first wavelength through a protective dome; and a second light source positioned to emit light at a second wavelength into an end surface of said protective dome, said second wavelength being different from said first wavelength, said protective dome being configured to direct said light at said second wavelength outwardly from said dome;

wherein said protective dome comprises a plurality of surfaces configured to direct said light at said second wavelength outwardly from said dome; and a signal source coupled to said event notification appliance, said signal source providing an output to said event notification appliance in response to detection of a fire or a non-fire alert condition;

said event notification appliance being configured to energize said first light source or said second light source in response to said output from said signal source to provide a visual notification of said fire or said non-fire alert condition.

8. The system of claim 7 wherein said signal source comprises a controller coupled to a detection device, said controller being configured to receive data from said detection device and provide said output in response to said data.

9. The system of claim 7 wherein said second light source is positioned adjacent said reflector, wherein said reflector is configured to reflect at least a portion of said light at said second wavelength.

10. The system of claim 7 further comprising a housing comprising a first lettering and a second lettering.

11. The system of claim 10 wherein said second light source is coupled to said housing.

12. The system of claim 10 wherein said first lettering and said second lettering are defined by said housing, and wherein said appliance further comprises a first illumination source configured for backlighting said first lettering to indicate a fire condition and a second illumination source configured for backlighting said second lettering to indicate an alert condition.

13. The system of claim 10 further comprising a first event indicator adjacent said first lettering and a second event indicator adjacent said second lettering.

14. A method of indicating an event, said method comprising:

detecting said event;

energizing a first light source of an event notification appliance if said event is a fire event, said first light source emitting light at a first wavelength through a protective dome; and energizing a second light source of said event notification appliance if said event is a non-fire alert condition, said second light source positioned and emitting light at a second wavelength into an end surface of said protective dome, said second wavelength being different from said first wavelength, said protective dome directing said light at said second wavelength outwardly from said dome;

wherein said protective dome comprises a plurality of surfaces configured to direct said light at said second wavelength outwardly from said dome.

15. The method of claim 14 wherein said first and second light sources are positioned adjacent a reflector configured to reflect at least a portion of said light at said first and second wavelengths.

16. The method of claim 14, said method further comprising illuminating lettering on said notification appliance in response to said event.

17. The method of claim 14 said method further comprising energizing an event indicator light source adjacent lettering on said notification appliance in response to said event.

* * * * *